US007920799B2

(12) United States Patent
Wada et al.

(10) Patent No.: US 7,920,799 B2
(45) Date of Patent: Apr. 5, 2011

(54) IMAGE FORMING APPARATUS FOR CONTROLLING REPLENISHING TONER INTO DEVELOPING DEVICE

(75) Inventors: Minoru Wada, Osaka (JP); Hisashi Mukataka, Osaka (JP); Eiji Gyoutoku, Osaka (JP); Kenichi Kasama, Osaka (JP)

(73) Assignee: Kyocera Mita Corporation (JP)

( * ) Notice: Subject to any disclaimer, the term of this patent is extended or adjusted under 35 U.S.C. 154(b) by 421 days.

(21) Appl. No.: 12/117,349

(22) Filed: May 8, 2008

(65) Prior Publication Data

US 2008/0285986 A1 Nov. 20, 2008

(30) Foreign Application Priority Data

May 15, 2007 (JP) ..... 2007-129438

(51) Int. Cl.
*G03G 15/08* (2006.01)

(52) U.S. Cl. ..... 399/27

(58) Field of Classification Search ..... 399/27, 399/222, 252, 258

See application file for complete search history.

(56) References Cited

U.S. PATENT DOCUMENTS

2006/0029405 A1 * 2/2006 Tanaka et al. ..... 399/27

FOREIGN PATENT DOCUMENTS

JP 2003-223045 8/2003
JP 2007079163 A * 3/2007

* cited by examiner

*Primary Examiner* — Quana M Grainger
(74) *Attorney, Agent, or Firm* — Gerald E. Hespos; Michael J. Porco

(57) ABSTRACT

An image forming apparatus is provided with a photoconductor to have an electrostatic latent image formed thereon, a developing device for developing the electrostatic latent image with a toner, a toner replenishing device for replenishing the toner into the developing device, and a controller for controlling an image developing operation by the developing device and a toner replenishing operation by the toner replenishing device. The controller executes a non-replenishment mode for causing the developing device to perform image development without being replenished with the toner from the toner replenishing device, a discharge mode, following the non-replenishment mode, for discharging the toner remaining in the developing device and a refill mode, following the discharge mode, for refilling the toner into the developing device by the toner replenishing device.

7 Claims, 8 Drawing Sheets

IMAGE FORMING APPARATUS FOR CONTROLLING REPLENISHING TONER INTO DEVELOPING DEVICE

BACKGROUND OF THE INVENTION

1. Field of the Invention

The present invention relates to an electrophotographic image forming apparatus, particularly to a toner supply control in a developing device using a one-component developer (toner).

2. Description of the Related Art

In recent years, due to the growing awareness of environmental protection, there has been an increasing need for developing devices capable of achieving a longer life through the replenishment of toner even for those using a one-component developer, which have been conventionally disposable. In this case, a method for detecting a toner remaining amount of the developing device by means of a remaining amount detecting sensor and replenishing the toner from a toner container connected with the developing device if the toner remaining amount decreases is generally used as a method for replenishing the toner.

On the other hand, image forming apparatuses are being entirely downsized due to the recent years' space saving demand and, accordingly, developing devices are also being downsized. If toner is replenished by detecting a toner remaining amount in a downsized image forming apparatus, the toner is replenished after the toner remaining amount is decreased to an extremely low level.

In this case, the replenished toner might transfer straight to a developing roller to form linear nonuniformity. If the replenished toner concentrates near the developing roller, the toner remaining in the developing device thus far might cause a charge failure, thereby causing an image defect (e.g. fogging).

Thus, in the case of replenishing the toner into the downsized developing device, it is effective to conduct such a management that the toner is replenished while a sufficient amount of the toner still remains.

The arrangement of a full detecting sensor in an upper part of a toner hopper and the arrangement of a remaining amount detecting sensor below the full detecting sensor (see, for example, Japanese Unexamined Patent Publication No. 2003-223045) is known as prior art for conducting this type of management. In this prior art, the toner supply is stopped if the full state of the toner is detected by the full detecting sensor at the time of filling the toner, and the replenishment of the toner is started when the remaining amount detecting sensor detects that the toner remaining amount has decreased.

However, the above prior art is studied for two-component development using a two-component developer and cannot be applied as it is to one-component development using a one-component developer. In other words, according to the prior art, the remaining amount detecting sensor detects that the toner remaining amount has decreased and the full state is detected using the other sensor at the time of replenishment.

If such a method is applied to one-component development, the toner replenishment is, due to the space restriction, started after the toner remaining amount decreases to an extremely low level. Thus, a large amount of toner is replenished, which might cause the charge failure and the linear nonuniformity.

Accordingly, in the case of the one-component development, it is effective to arrange one toner amount sensor near a full position of the developing device and to replenish the toner little by little while the full state is monitored by the toner amount sensor. In this way, occurrences of the charge failure and the linear nonuniformity can be prevented for a certain period.

However, in the case of stopping the disposable use of the developing device using the one-component developer and aiming to further extend the life as described above, the toner in the developing device is deteriorated by the long-term use. In this case, the charge failure of the toner eventually occurs even if the toner is replenished little by little.

SUMMARY OF THE INVENTION

An object of the present invention is to provide an image forming apparatus which can suppress occurrences of fogging and linear nonuniformity of images caused by the replenishment of toner and can be used over a long term without replacing a developing device.

The present invention is directed to an image forming apparatus, comprising a photoconductor to have an electrostatic latent image formed thereon; a developing device for developing the electrostatic latent image with a toner; a toner replenishing device for replenishing the toner into the developing device; and a controller for controlling an image developing operation by the developing device and a toner replenishing operation by the toner replenishing device, wherein the controller executes a non-replenishment mode for causing the developing device to perform image development without being replenished with the toner from the toner replenishing device, a discharge mode, following the non-replenishment mode, for discharging the toner remaining in the developing device and a refill mode, following the discharge mode, for refilling the toner into the developing device by the toner replenishing device.

DETAILED DESCRIPTION OF THE PREFERRED EMBODIMENTS

The invention is now described, by way of example, with reference to the accompanying drawings.

Figure 1:
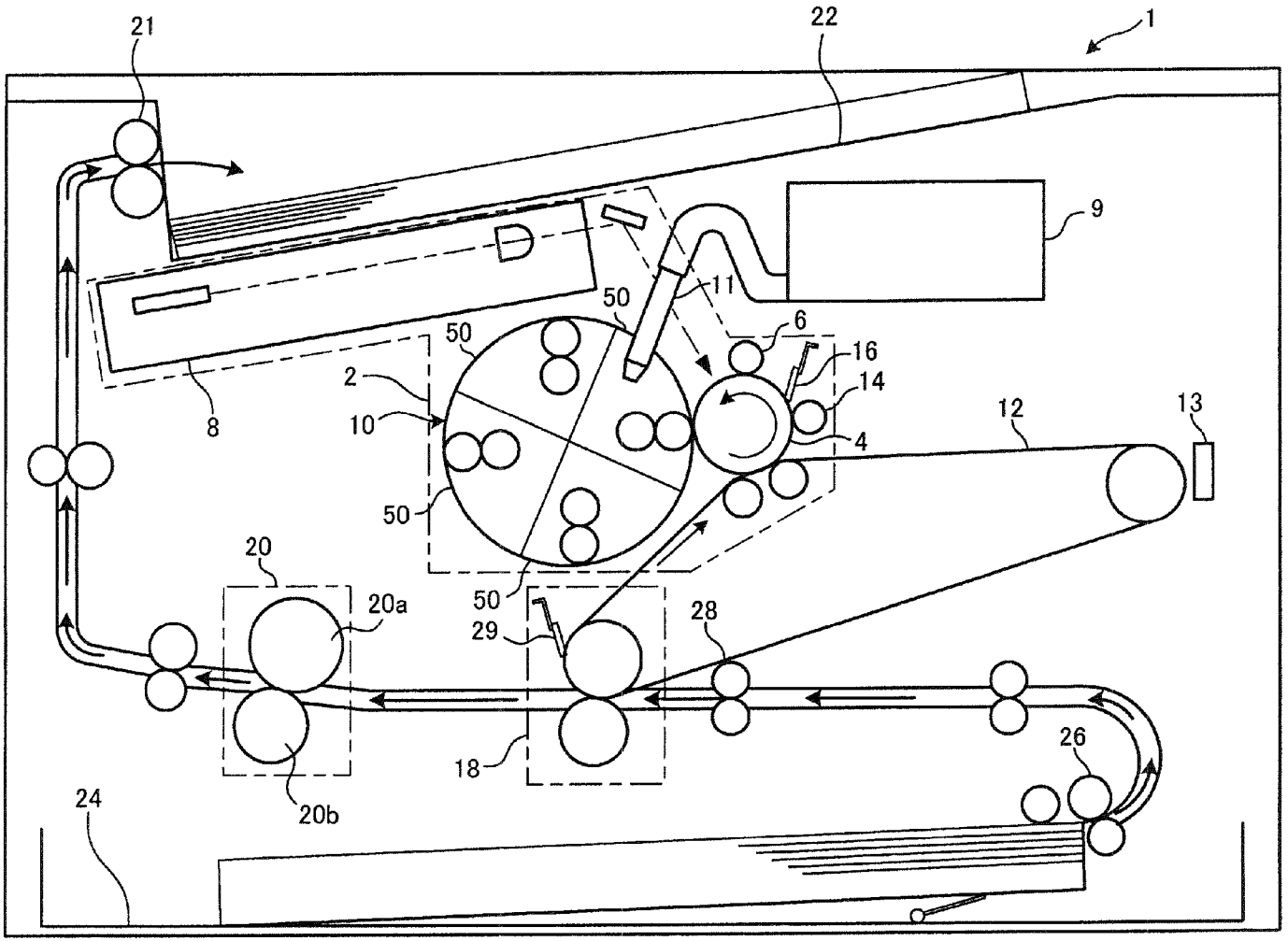
FIG. 1 is a schematic diagram showing an exemplary construction of an image forming apparatus according to one embodiment of the invention.

Hereinafter, one embodiment of an image forming apparatus according to the present invention is described. FIG. 1 is a schematic diagram showing an exemplary construction of the image forming apparatus 1 according to one embodiment of the invention. In FIG. 1, right side corresponds to the front side of the image forming apparatus 1 and left side to the rear side thereof. Accordingly, transverse directions of FIG. 1 coincide with forward and backward directions of the image forming apparatus 1. It should be noted that a schematic section shown in FIG. 1 is a vertical section of the image forming apparatus 1 when viewed from the left side.

The image forming apparatus 1 is provided with an image forming unit 2 in a main body thereof. The image forming unit 2 mainly includes a photoconductive drum 4, a charger 6, a laser scanning unit 8 and a developing unit 10.

The photoconductive drum 4 is a rotary drum and has a photoconductive layer made of, e.g. an amorphous silicon formed on the outer circumferential surface thereof. The photoconductive drum 4 rotates in a counterclockwise direction of FIG. 1. As the photoconductive drum 4 rotates, a series of operations including the formation of an electrostatic latent image, image development with toner, and the primary transfer of a toner image are performed on the outer circumferential surface of the photoconductive drum 4.

The charger 6 is disposed above the photoconductive drum 4. The outer circumferential surface of the photoconductive drum 4 is charged by the charger 6. With the photoconductive drum 4 charged, a scanning beam as an image signal is irradiated from the laser scanning unit 8 toward the outer circumferential surface of the photoconductive drum 4. The position of irradiation of the scanning beam on the photoconductive drum 4 is downstream of the charger 6 in the rotating direction of the photoconductive drum 4.

The laser scanning unit 8 reflects a laser beam while rotating, for example, a polygon mirror at a high speed, and reflects the laser beam (scanning beam) scanned in the axial line direction of the photoconductive drum 4 by a plane mirror to expose the outer circumferential surface of the photoconductive drum 4. In this way, an electrostatic latent image is formed on the outer circumferential surface of the photoconductive drum 4.

The developing unit 10 is arranged at a position downstream of the position of irradiation in the rotating direction of the photoconductive drum 4 and proximate to the outer circumferential surface of the photoconductive drum 4. The developing unit 10 develops the electrostatic latent image by a rotary method using toners of four colors (e.g. magenta, cyan, yellow and black). The developing unit 10 has a rotatable structure and includes four developing devices 50 divided according to the respective colors in a rotating direction thereof. In this embodiment, one-component developer made of toner particles added with titanium oxide ($TiO_2$) as electrically conductive fine particles on the outer surfaces thereof can be used as the toners.

Further, a toner container 9 is built in the image forming apparatus 1. The toner container 9 replenishes the respective developing devices 50 with the toners of the respective colors through replenishing pipes 11. In this embodiment is adopted a full detecting method for constantly keeping the toner amounts constant by replenishing the toners while detecting the toner amounts in the respective developing devices 50 by means of toner amount sensors 57 (see FIG. 5). It should be noted that the control of a toner replenishing operation in this embodiment is described later.

The rotary developing unit 10 stops any one of the four developing devices 50 corresponding to the color to be developed at a position facing the outer circumferential surface of the photoconductive drum 4 while being rotated. At this time, a developing roller rotates while carrying a thin toner layer on the outer circumferential surface thereof in the developing device 50 corresponding to the color to be developed.

A development bias voltage comprised of an AC component and a DC component is applied to each developing roller. The toner carried on the developing roller is transferred toward the electrostatic latent image on the photoconductive drum 4 by this development bias voltage. Thus, the electrostatic latent image is developed with the toner of the corresponding color and a toner image as a visible image is formed on the outer circumferential surface of the photoconductive drum 4.

An endless intermediate transfer belt 12 is arranged below the photoconductive drum 4. A belt formed by joining the opposite ends of a sheet member made of a dielectric resin or a seamless belt is, for example, used as the intermediate transfer belt 12.

The intermediate transfer belt 12 rotates in synchronism with the rotation of the photoconductive drum 4 and passes a position in contact with the outer circumferential surface of the photoconductive drum 4. The toner image formed on the photoconductive drum 4 is primarily transferred to the outer surface of the intermediate transfer belt 12 from the outer circumferential surface of the photoconductive drum 4 as the photoconductive drum 4 rotates.

Around the photoconductive drum 4, an abrading member 14 and a cleaning member 16 are arranged along the outer circumferential surface of the photoconductive drum 4.

The abrading member 14 and the cleaning member 16 are located downstream of the position where the photoconductive drum 4 is in contact with the intermediate transfer belt 12 and upstream of the charger 6 in the rotating direction of the photoconductive drum 4.

The abrading member 14 abrades the outer circumferential surface of the photoconductive drum 4 after the primary transfer of the toner image to remove an oxidation product adhering to the amorphous silicon photoconductive layer of the photoconductive drum 4.

The cleaning member 16 removes the toner residual on the outer circumferential surface of the photoconductive drum 4 to clean this outer circumferential surface before the next image formation.

At the time of forming a full color image, electrostatic latent images are successively formed on the photoconductive drum 4 for the respective colors, and toner images developed color by color are successively primarily transferred to the intermediate transfer belt 12 in a superimposed manner. In this way, a color image of one page is synthesized.

A transfer unit 18 is formed at one end of the intermediate transfer belt 12. The transfer unit 18 transfers a primarily transferred toner image of one page to a sheet. An image density (ID) sensor 13 is disposed at the other end of the intermediate transfer belt 12. The image density sensor 13 detects the density of a patch image transferred to the outer surface of the intermediate transfer belt 12, for example, at the time of calibration and outputs a detection signal.

A sheet conveying direction is shown by arrows in FIG. 1. A fixing unit 20 is arranged downstream of the transfer unit 18 in the sheet conveying direction. The fixing unit 20 heats and presses the sheet having the toner image transferred thereto between a heat roller 20*a* and a pressure roller 20*b*. In this way, the toner image is fixed to the sheet. Thereafter, the sheet is conveyed upward in the image forming apparatus 1 and discharged to an upper tray 22 via discharge rollers 21.

Sheets to have toner images transferred thereto are accommodated in a stacked state in a sheet cassette 24 at the bottom of the image forming apparatus 1. These sheets are dispensed one by one from the uppermost one and conveyed to the transfer unit 18 via feed rollers 26 and registration rollers 28.

The registration rollers 28 temporarily stops the sheet while holding it therebetween, corrects the inclination and skew of the sheet and feeds the sheet at a timing in synchronism with the movement of the intermediate transfer belt 12. In this way, a toner image of one page is precisely transferred to a specified position of the sheet. A belt cleaning member 29 is disposed near the transfer unit 18 for cleaning the residual toner and the like adhering to the intermediate transfer belt 12 after the transfer of the toner image.

Figure 2:
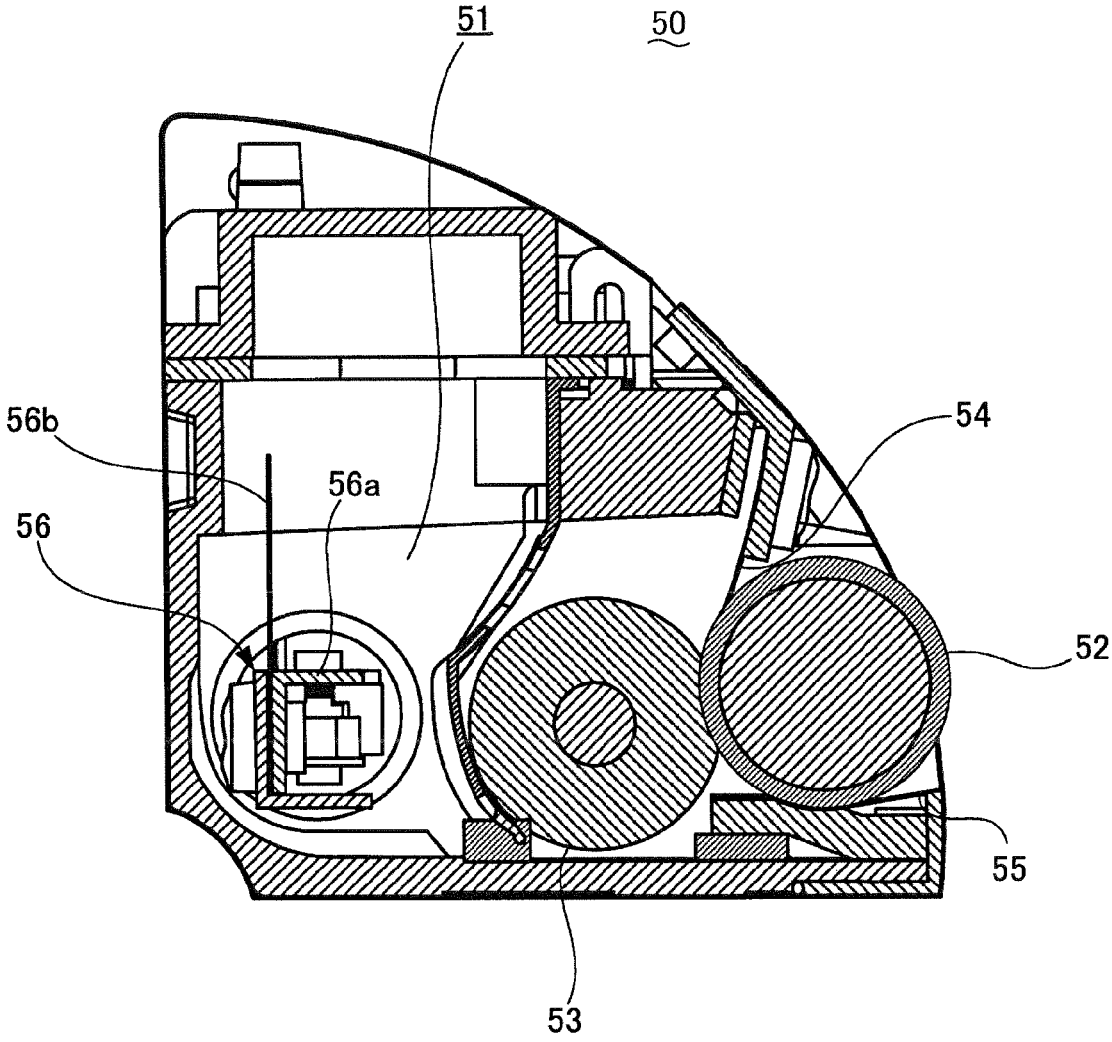
FIG. 2 is a vertical section enlargedly showing a developing device.

FIG. 2 is a vertical section enlargedly showing one developing device 50 constituting the rotary developing unit 10. Since the four developing devices 50 have substantially the same construction, description is made, taking one developing device 50 (corresponding color does not matter) as an example here.

The developing device 50 includes a developing roller 52. The outer circumferential surface of the developing roller 52 is partly exposed to the outside of the developing device 50, and this exposed part develops an electrostatic latent image on the photoconductive drum 4. On the other hand, a supply roller 53 is provided in the developing device 50. The supply roller 53 rotates in the same direction (clockwise direction in FIG. 2) as the developing roller 52 to supply the toner to the outer circumferential surface of the developing roller 52 and to collect the toner not used for image development.

A restricting member 54 is disposed at an upper left side of the developing roller 52. The restricting member 54 restricts (regulates) the layer thickness of the toner supplied from the supply roller 53 as the developing roller 52 rotates and also charges the toner. A sealing member 55 is disposed below the developing roller 52. The sealing member 55 seals a part where the toner layer after the image development returns into the developing device 50 to prevent the toner from dropping.

A hopper portion 51 is formed in the developing device 50. The hopper portion 51 is a space having a specified volume and replenished with the toner of the corresponding color from the toner container 9. The hopper portion 51 includes an agitating member 56 comprised of an agitating shaft 56*a* and a film-shaped agitating blade 56*b* fixed to the agitating shaft 56*a*. The agitating blade 56*b* is, for example, made of a PET (polyethylene terephthalate) having a thickness of 100 μm. The agitating blade 56*b* extends in the longitudinal direction of the agitating shaft 56*a* and projects into the hopper portion 51 from the agitating shaft 56*a*. The agitating member 56 agitates the toner in the hopper portion 51 by the agitating blade 56*b* as being rotated, thereby causing the toner to flow, and levels the toner in the hopper portion 51 in the longitudinal direction of the agitating shaft 56*a*.

Figure 3:
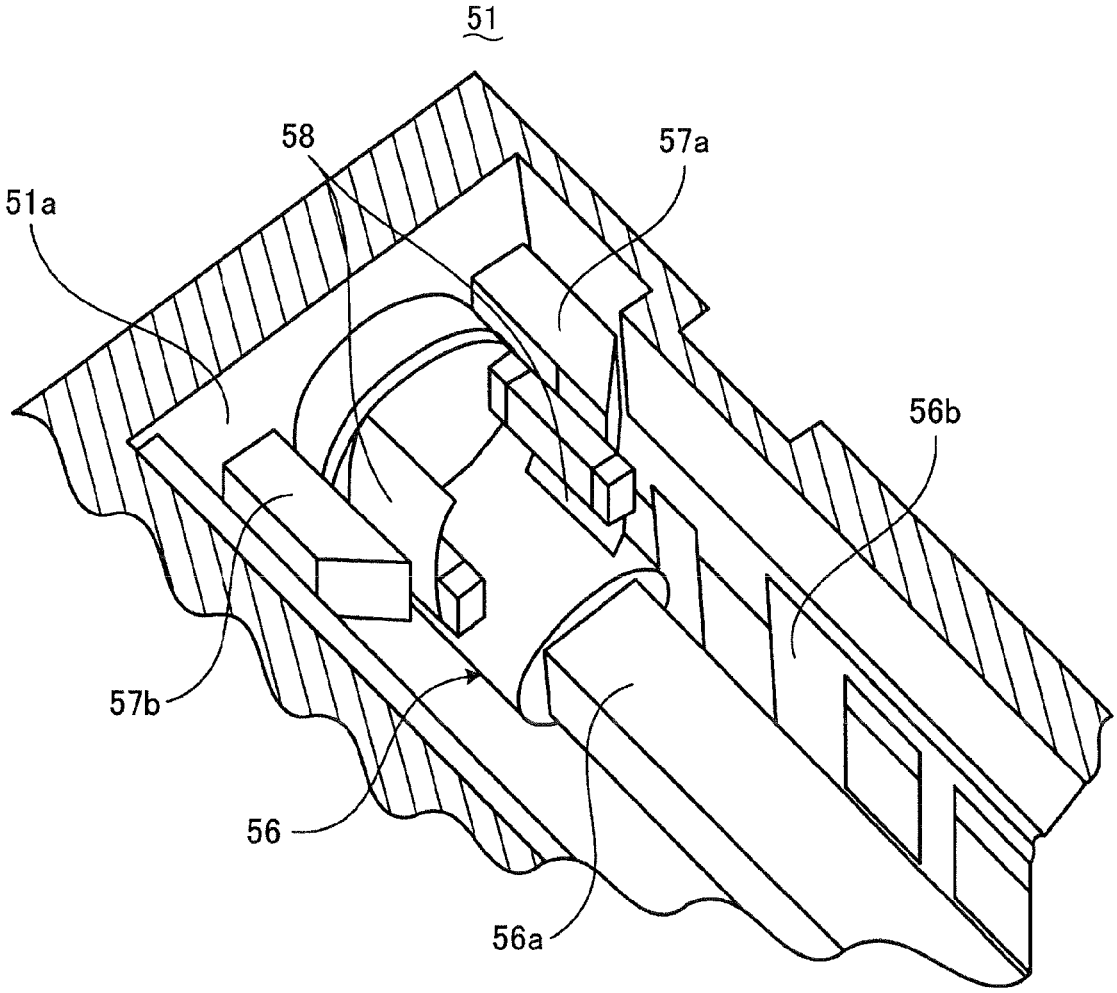
FIG. 3 is a perspective view partly showing a hopper portion in the developing device.
Figure 4:
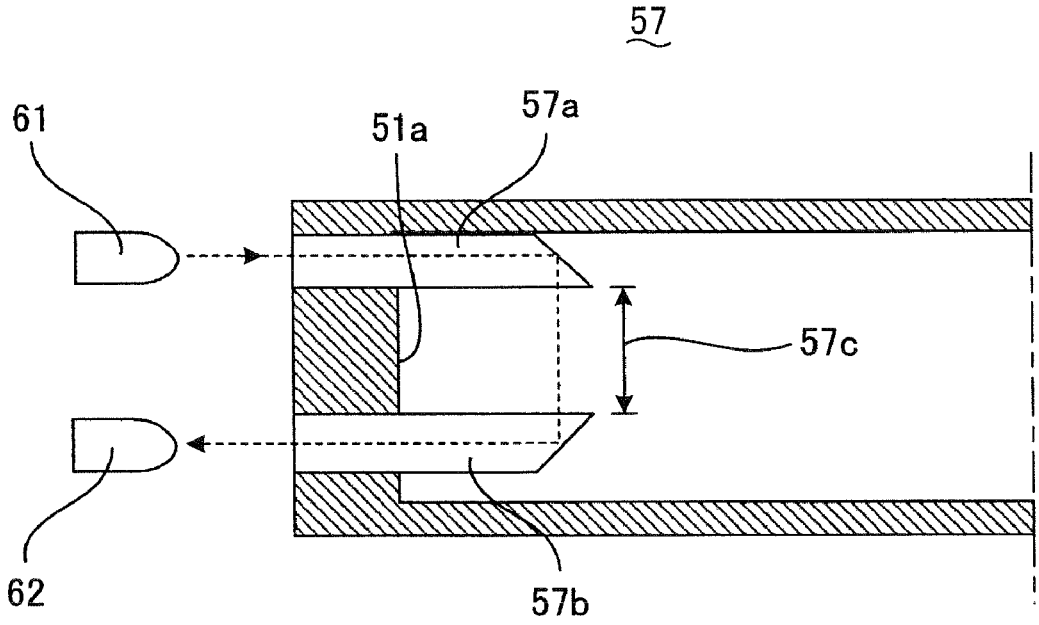
FIG. 4 is a horizontal section schematically showing the construction of a toner amount sensor.

FIG. 3 is a perspective view showing a part of the hopper portion 51 in the developing device 50 and FIG. 4 is a horizontal section schematically showing the construction of a toner amount sensor 57. As shown in FIGS. 3 and 4, a pair of light guiding members 57*a*, 57*b* are provided near one longitudinal end of the agitating shaft 56*a* in the hopper portion 51. The light guiding members 57*a*, 57*b* penetrate through a side wall 51 of the hopper portion 51 and extend in the longitudinal direction of the agitating shaft 56*a* in the hopper portion 51. The insides of the light guiding members 57*a*, 57*b* have a light guiding property, and the leading ends thereof cut to have a tapered shape (45°) fully reflect the light.

As shown in FIG. 3, the agitating member 56 includes two cleaning members 58. The cleaning members 58 rotate about an unillustrated axis to clean the smear on the surfaces of the light guiding members 57*a*, 57*b*.

As shown in FIG. 4, a light emitter 61 and a light receiver 62 are disposed outside the developing device 50. A sensor beam emitted from the light emitter 61 is introduced into the hopper portion 51 by the emission side light guiding member 57*a*, is fully reflected at the leading end of the light guiding member 57*a* and enters the reception side light guiding member 57*b* through a detecting portion 57*c*. The sensor beam is fully reflected at the leading end of the reception side light guiding member 57*b* to be introduced to the light receiver 62 outside.

The toner amount sensor 57 detects a toner remaining amount level in the hopper portion 51 using the sensor beam received by the light receiver 62. In normal time, while the toner remaining amount is detected by the toner amount sensor 57, a control is executed to replenish the toner until the full state is detected if a toner insufficient state is detected.

Figure 5:
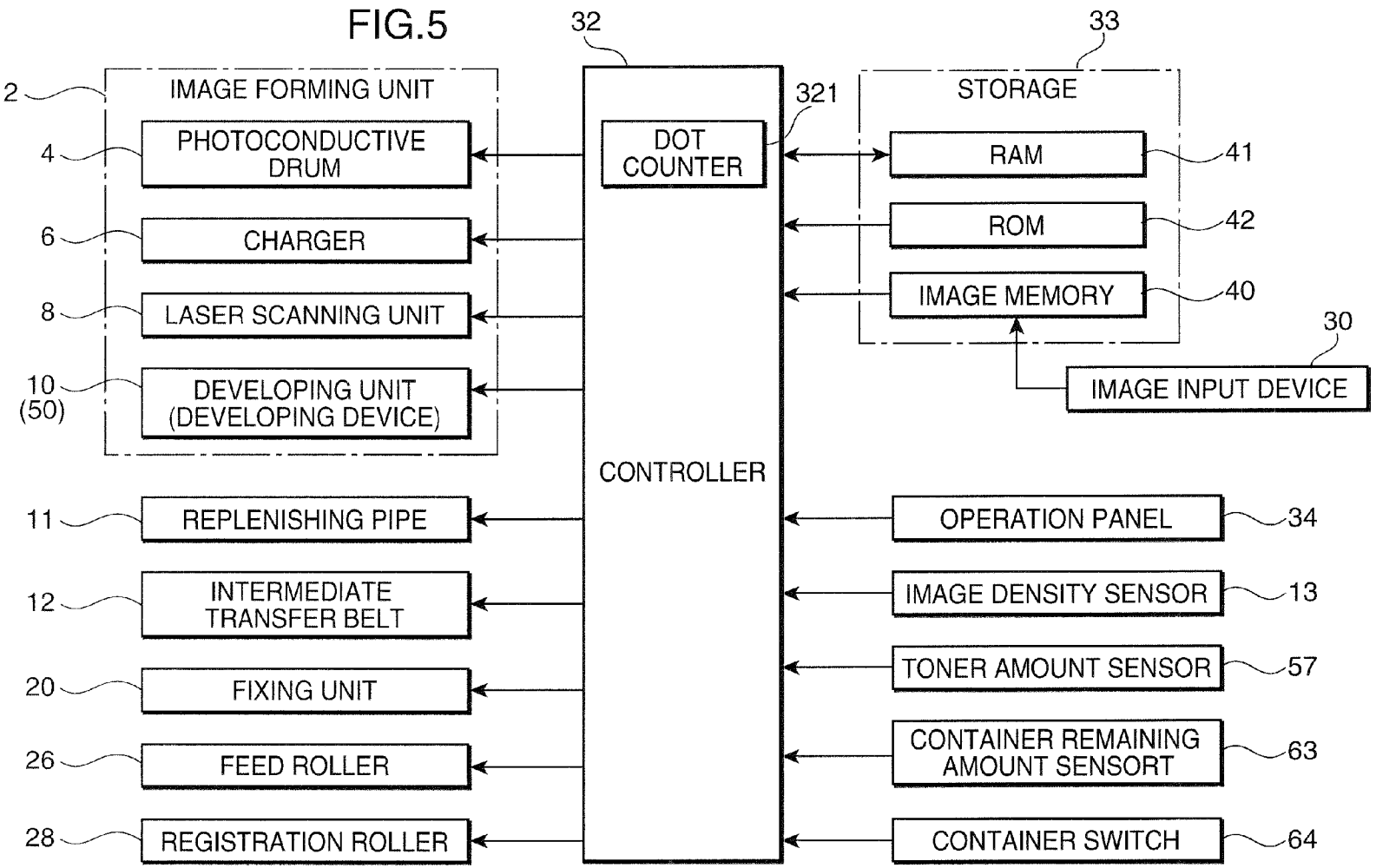
FIG. 5 is a block diagram showing a construction relating to the control of the image forming apparatus.

Next, a construction relating to the control of the image forming apparatus 1 is described. FIG. 5 is a block diagram showing the construction relating to the control of the image forming apparatus 1. The image forming apparatus 1 includes the image forming unit 2, the intermediate transfer belt 12, the fixing unit 20, the feed rollers 26 and the registration rollers 28. The image forming apparatus 1 also includes an image input device 30, a controller 32, a storage 33, an operation panel 34, the image density sensor 13, the toner amount sensor 57, a container remaining amount sensor 63 and a container switch 64.

The image input device 30 functions as a receiver for receiving image signals (image data of all the pages) transmitted, for example, from an external personal computer or the like and also as a scanner if the image forming apparatus 1 is a copier or a complex machine. The scanner is provided with a scanning optical system including a scanner lamp for illuminating a document, for example, at the time of copying and a mirror for changing an optical path of a reflected light from the document, a condenser lens for condensing and focusing the reflected light from the document, and a CCD for converting the focused image light into an electrical signal. An image signal inputted to the image input device 30 is transferred to an image memory 40 in the storage 33 after applying a signal processing (e.g. P/S conversion, A/D conversion) if necessary.

The storage 33 includes the image memory 40, a RAM 41 and a ROM 42. The image memory 40 is a buffer for storing an image signal transferred from the image input device 30 and transferring it to the controller 32. The RAM 41 and ROM 42 store a processing program of the controller 32, contents of processing, etc.

The operation panel 34 includes an operation section having a plurality of operation keys and a display section (neither of these sections is shown) for displaying set conditions, states of the apparatus and the like. The display section includes, for example, a liquid crystal display. Here, the display section may include a touch panel for receiving operations from a user via a display screen.

The operation panel 34 is arranged on the outer surface of an outer covering of the image forming apparatus 1 and receives the setting such as a print condition the user inputs by means of the operation keys. If, for example, the image forming apparatus 1 has a facsimile function, the operation panel 34 is used for various settings such as the registration of a facsimile destination in the storage 33, the readout and rewriting of the registered destination.

Driving devices including the photoconductive drum 4, the developing unit 10, the intermediate transfer belt 12 and the fixing unit 20 are driven by an unillustrated main motor.

The controller 32 has a function of controlling the rotation of the main motor to properly operate the various driving devices. In the case of driving or stopping any one of the driving devices, the controller 32 connects or disconnects a clutch mechanism (not shown) disposed between the main motor and the driving device. It should be noted that special motors may be connected to the respective driving devices to individually drive the driving devices.

A toner amount detection signal is inputted to the controller 32 from the toner amount sensor 57 including the light emitter 61 and the light receiver 62 shown in FIG. 4. A detection signal from the image density sensor 13 is also inputted to the controller 32. Since the toner amount sensor 57 is shown in FIG. 4, it is not described here.

Detection signals from the container remaining amount sensor 63 and the container switch 64 are also inputted to the controller 32. The container remaining amount sensor 63 detects either a small toner remaining amount (LOW) or no toner remaining amount (EMPTY) in the toner container 9 and outputs a detection signal to the controller 32. The container switch 64 detects the replacement of the toner container 9 and outputs a detection signal to the controller 32.

The controller 32 is connected to a drive motor (not shown) for feeding transfer sheets and conveying and discharging sheets having images transferred thereto, and outputs a control signal to the drive motor. By the control of the rotational state of the drive motor by the controller 32, the rotational states of the feed rollers 26, the registration rollers 28, the discharge rollers 21 and the like are controlled.

The controller 32 generally controls the image input device 30, the image forming unit 2, the fixing unit 20 and the like in accordance with a preset program. The controller 32 also converts an image signal inputted from the image input device 30 through a magnification changing process or a gradation process if necessary. Further, the controller 32 divides the converted image signal into four image signals of the respective colors, i.e. magenta, cyan, yellow and black to form a color image.

Then, the controller 32 outputs the image signals of the respective colors to the laser scanning unit 8 of the image forming unit 2 in a specified sequence. The laser scanning unit 8 generates a pulsed laser beam in accordance with the image signals outputted from the controller 32 and reflects it by the polygon mirror to irradiate the outer circumferential surface of the photoconductive drum 4.

On the other hand, the image forming unit 2 individually (for the respective colors) outputs synchronization signals to the controller 32. These synchronization signals are used to synchronize the output timings of the image signals of the respective colors. When the developing unit 10 is to perform image developments for the respective colors, the image forming unit 2 outputs the synchronization signals to the controller 32. On the other hand, the controller 32 outputs the image signals of the respective colors to the image forming unit 2 upon receiving the synchronization signals of the respective colors from the image forming unit 2.

The above is a summary of the image formation control in the image forming apparatus 1. In addition, in this embodiment, the controller 32 performs a toner refreshing process for refreshing the toner in each developing device 50 as described below in order to prevent the deterioration of the toner in the developing device 50.

Specifically, the controller 32 executes a non-replenishment mode for causing the developing device 10 to develop images without being replenishing with the toner into from the toner container 9; a discharge mode, following the non-replenishment mode, for discharging the remaining toner in the developing device 10; and a refill mode, following the discharge mode, for refilling the toner into the developing device 10 from the toner container 9.

In this case, the controller 32 preferably executes a control in the non-replenishment mode after the replacement of the toner container 9 is detected by the container switch 64.

Preferably, the controller 32 also includes a dot counter 321 for counting the dot number of an image to be printed and estimates the amount of the toner used for image development by the developing unit 10 during the execution of the non-replenishment mode upon transferring from the non-replenishment mode to the discharge mode.

In this case, the dot counter 321 may, for example, store the image signal in the image memory 40 and count the dot number in an area made of pixels except margins.

Further, the controller 32 preferably replenishes the toner by means of the toner container 9 with the image development by the developing unit 10 stopped until a specified reference amount of the toner is replenished into the developing unit 10 during the execution of the refill mode.

Furthermore, the controller 32 preferably causes the toner to flow by the agitating member 56 after the toner is replenished into the developing unit 10 by the toner container 9 during the execution of the refill mode.

Further, the controller 32 preferably executes the discharge mode by causing the developing device 50 to develop a solid image.

In this case, the controller 32 preferably changes the mode from the discharge mode to the refill mode if the density of the solid image detected by the image density sensor 13 is lower than a specified density.

The toner is deteriorated, for example, when the toner stays in the developing device 50 for a long time. Toner deterioration phenomena include, for example, the loss of an externally added agent and the immersion of the externally added agent into the toner.

First Example

Figure 6:
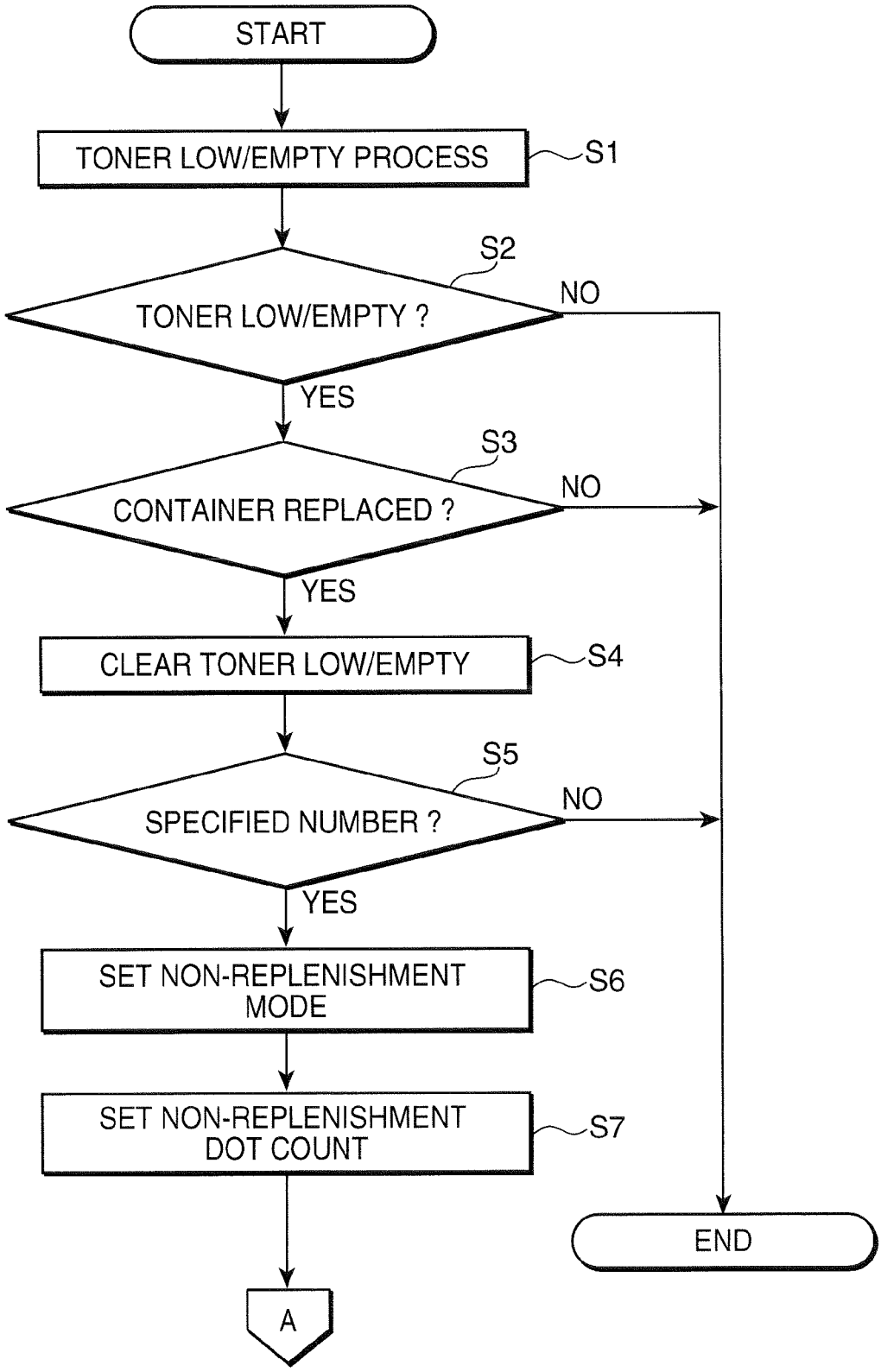
FIG. 6 is a flow chart (1/2) showing the procedure of a toner refreshing process.
Figure 7:
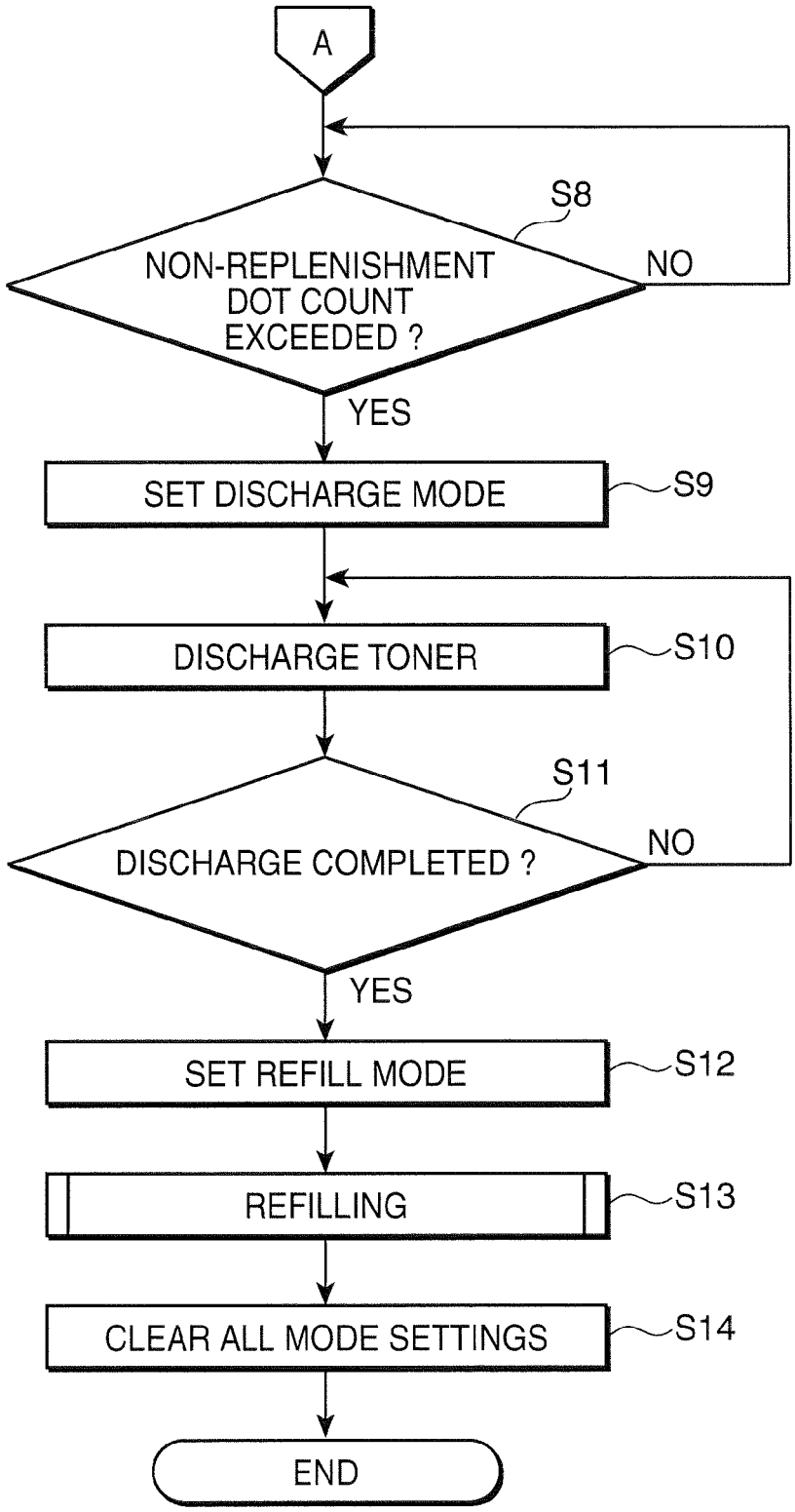
FIG. 7 is a flow chart (2/2) showing the procedure of the toner refreshing process.

FIGS. 6 and 7 are flow charts showing the procedure of the toner refreshing process performed by the controller 32. A first example of the toner refreshing process is described below.

The controller 32 executes a toner LOW/EMPTY process to check whether the toner remaining amount in the toner container 9 is in a LOW level or in an EMPTY level by monitoring a detection signal outputted from the container remaining amount sensor 63 (Step S1). Thereafter, the controller 32 monitors detection signals from the container remaining amount sensor 63 and the container switch 64.

Subsequently, the controller 32 finishes the toner refreshing process unless it is confirmed through the toner LOW/EMPTY process that the toner remaining amount in the toner container 9 is in the LOW level or in the empty level (NO in Step S2).

On the other hand, the controller 32 checks whether or not the toner container 9 has been replaced based on the detection signal from the container switch 64 if it is confirmed through the toner LOW/EMPTY process that the toner remaining amount in the toner container 9 is in the LOW level or in the empty level (YES in Step S2).

Subsequently, the controller 32 finishes the toner refreshing process unless the toner container 9 has been replaced (NO in Step S3).

Subsequently, the controller clears a confirmation result on a small toner remaining amount (LOW) or no toner remaining amount (EMPTY) for the toner container 9 after the replacement (Step S4) if the replacement of the toner container 9 is confirmed (YES in step S3).

Subsequently, the controller 32 checks whether or not a total print number after the execution of the last toner refreshing process is a specified number or larger (Step S5). It should be noted that the value of the specified number is empirically set beforehand based on the deterioration speed of the toner in the developing device 50 (e.g. about several thousands to several ten thousands).

Subsequently, the controller 32 finishes the toner refreshing process unless it is confirmed that the total print number is the specified number or larger (NO in Step S5).

On the other hand, the controller 32 sets the "non-replenishment mode" (Step S6) if it is confirmed that the total print number is the specified number or larger (YES in Step S5). The controller 32 stops the replenishment by the full detecting method using the toner amount sensor 57 and does not replenish the toner from the toner container 9 upon setting the "non-replenishment mode". Thus, subsequent image forming (printing) operations are performed using only the toner remaining in the hopper portion 51 of the developing device 50.

Subsequently, the controller 32 sets a "non-replenishment dot count" (Step S7). The "non-replenishment dot count" is the number of dots that can be outputted during the image formation after the "non-replenishment mode" is set. Here, a predetermined value can be adopted as the "non-replenishment dot count". It should be noted that the dot number is substantially proportional to the size of a print area (area where a toner image is to be transferred) on a sheet, a development density (development bias) and the like during the image formation. Therefore, the controller 32 can easily calculate the dot number.

Subsequently, the controller 32 checks whether or not the dot number calculated in the "non-replenishment mode" has exceeded the "non-replenishment dot count" (Step S8).

The controller 32 sets the "discharge mode" (Step S9) upon confirming that the "non-replenishment dot counter" has been exceeded (YES in Step S8).

When the controller 32 sets the "discharge mode", the developing device 50 discharges the toner (Step S10). Specifically, the controller 32 instructs the image forming unit 2 to form a solid image and causes the toner to be intensively consumed by discharging the deteriorated toner remaining in the developing device 50. The discharged toner is transferred from the photoconductive drum 4 to the intermediate transfer belt 12 and collected by the belt cleaning member 29.

Subsequently, the controller 32 judges whether or not the discharge of the toner has been completed (Step S11). Unless the discharge has been completed (NO in Step S11), this routine is returned to Step S10 to continue the discharging operation.

The controller 32 can make judgment as to whether or not the discharge of the toner has been completed, for example, based on the detection signal outputted from the image density sensor 13. Specifically, the controller 32 can judge that the discharge of the deteriorated toner from the developing device 50 has been almost completed if the density of the solid image is extremely decreased.

Subsequently, the controller 32 sets the "refill mode" (Step S12) to perform a refilling process (Step S13). In this refilling process, toner free from deterioration is replenished into the developing device 50 from the toner container 9 after the replacement.

Subsequently, the controller 32 clears all the mode settings and completes the toner refreshing process when the full state of the toner in the hopper portion 51 is detected by the toner amount sensor 57.

Second Example

Figure 8:
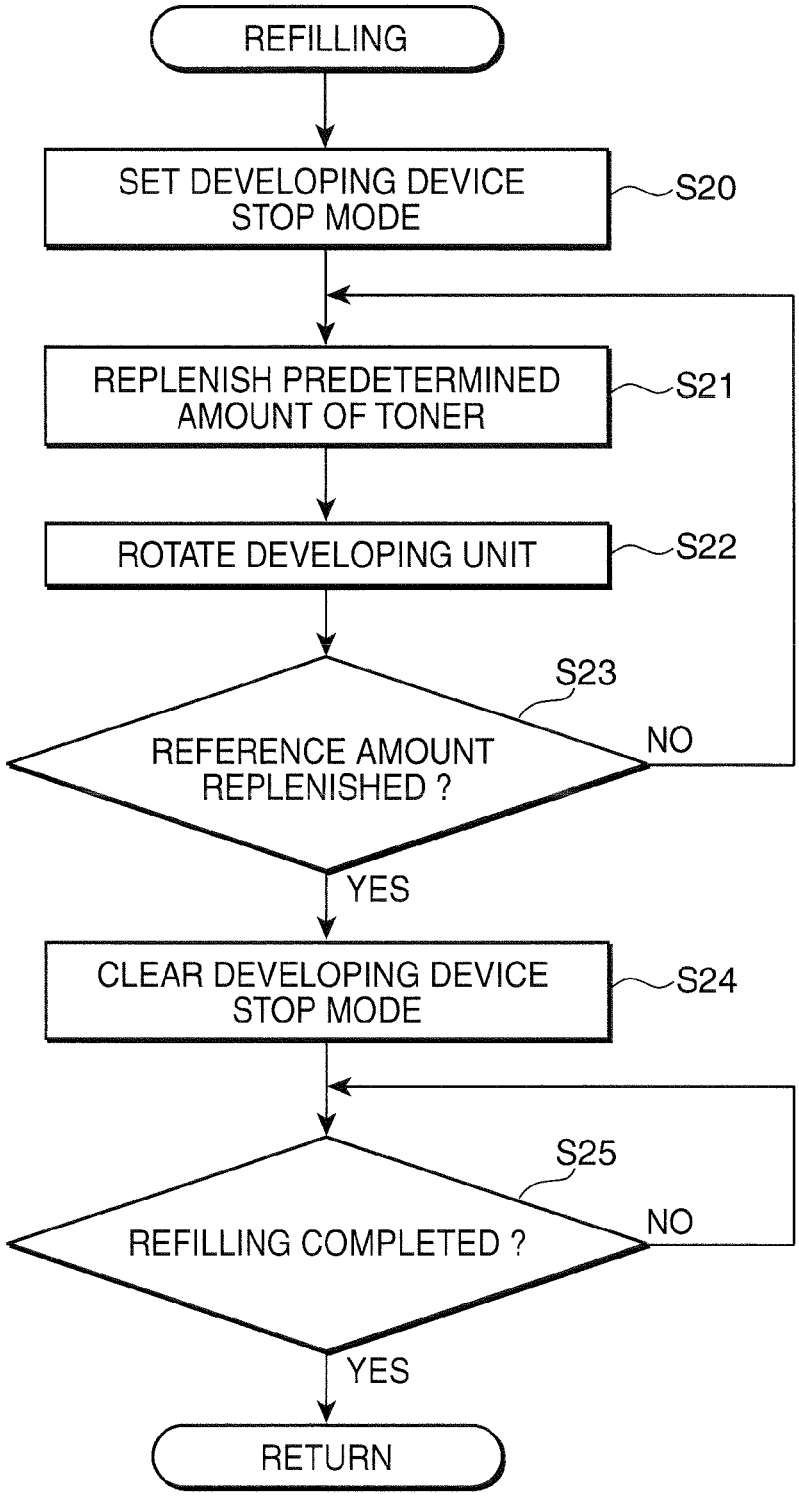
FIG. 8 is a flow chart showing a specific procedure of a refilling process.

Next, a second example of the toner refreshing process is described. In the second example, the following procedure is added in the refilling process (Step S13) of the first example. FIG. 8 is a flow chart showing a specific procedure of the refilling process in the second example.

The controller 32 sets a "developing device stop mode" (Step S20). The controller 32 stops the driving of the developing device 50 to stop the image forming operation upon setting the "developing device stop mode".

Subsequently, the controller 32 instructs the developing device 50 to replenish a predetermined amount (e.g. about 2 g) of the toner from the toner container 9 (Step S21).

Subsequently, the controller 32 causes the developing unit 10 to rotate (e.g. four rotations) when the predetermined amount of the toner is replenished (Step S22). This causes the toner replenished into the hopper portion 51 of the developing device 50 to flow and leveled in the longitudinal direction of the supply roller 53 and the developing roller 52. Although the toner is leveled by rotating the developing unit 10 in this embodiment, the leveling method is not limited to this and the toner may be leveled, for example, by rotating the agitating member 56. Further, fluidizing means such as the agitating member 56 may be operated independently of the developing roller 52 and the developing roller 52 may be stopped while the toner is leveled.

Subsequently, the controller 32 checks whether or not a reference amount of the toner has been replenished into the developing device 50 (Step S23). An amount (e.g. about 20 g), with which there is no likelihood that the toner comes out from the developing device 50 at the time of refilling, can be adopted as this reference amount. The controller 32 repeats the processings in Steps S21 and S22 unless the reference amount of the toner has not yet been supplied to the developing device 50 (NO in Step S23).

Subsequently, the controller 32 clears the "developing device stop mode" (Step S24) when it is confirmed that the reference amount of the toner has been replenished into the developing device 50 (YES in Step S23). Thereafter, the refilling is performed while the developing device 50 is driven.

Subsequently, the controller 32 checks whether or not the refilling has been completed (Step S25). The controller 32 returns the refilling process and proceeds to Step S14 shown in FIG. 7 if the full state is detected by the toner amount sensor 57 and the completion of the refilling is confirmed (YES in Step S25).

As described above, according to the image forming apparatus of this embodiment, the non-replenishment in which the image development is performed with the replenishing operation stopped is set when the deterioration of the toner in the developing device 50 progresses. Thus, the charge failure at the time of replenishment can be prevented and the deteriorated toner in the developing device 50 can be effectively used up. Further, upon approaching the toner remaining amount, with which an image defect might be caused, the discharge mode in which the deteriorated toner in the developing device 50 is discharged as much as possible is set. Thereafter, the refill mode in which new toner is filled into the developing device 50 is set to refresh the toner in the developing device 50. In this way, occurrences of fogging and linear nonuniformity at the time of toner replenishment can be prevented, and the developing device 50 (developing unit 10) can be used over a long term without being replaced.

Since the control is executed in the non-replenishment mode after the toner container 9 is replaced, a variation in the life of the toner containers 9 can be suppressed. In other words, if a transfer is made to the non-replenishment mode before the replacement of the toner container 9, the refill mode is started immediately after the replacement of the toner container 9 and the number of prints is counted after the completion of the refill mode.

Specifically, the counting of the number of prints is started after the toner in the toner container 9 is decreased by the refill mode, wherefore the lives of the same toner containers 9 become more different as compared to the case where no transfer is made to the non-replenishment mode.

On the other hand, if the control is executed in the non-replenishment mode after the toner container 9 is replaced, the number of prints made during the non-replenishment mode offsets the number of prints corresponding to the toner amount used in the refill mode. As a result, the toner container 9 has substantially the same life as in the case where no transfer is made to the non-replenishment mode, wherefore the variation in the lives of the toner containers 9 can be suppressed.

Further, since the developing roller 52 is not driven until the reference amount of the toner is replenished into the developing device 50 during the refilling, it can be prevented that a small amount of the toner remaining in the developing device 50 and the newly replenished toner are mixed and aggregated and the toner comes out of the developing device 50. Further, since the developing unit 10 is rotated during the refilling, the toner in the hopper portion 51 is leveled and, therefore, more toner can be filled.

The present invention is not limited to the above embodiment and various modifications can be made. The specific values (specified number of prints, predetermined amount, reference amount, etc.) used in the above embodiment are preferable examples and are not limiting.

Although the image forming apparatus 1 including the rotary developing unit 10 is illustrated in the above embodiment, the present invention is also applicable to tandem image forming apparatuses. In this case, the agitating member may be rotated in each developing device instead of the rotation of the developing unit 10 in Step S22 of FIG. 8.

(Outline of the Invention)

(1) An image forming apparatus according to the present invention comprises a photoconductor to have an electrostatic latent image formed thereon; a developing device for developing the electrostatic latent image with a toner, a toner replenishing device for replenishing the toner into the developing device; and a controller for controlling an image developing operation by the developing device and a toner replenishing operation by the toner replenishing device, wherein the controller executes a non-replenishment mode for causing the developing device to perform image development without being replenished with the toner from the toner replenishing device, a discharge mode, following the non-replenishment mode, for discharging the toner remaining in the developing device and a refill mode, following the discharge mode, for refilling the toner into the developing device by the toner replenishing device.

According to this construction, the controller executes the non-replenishment mode for causing the developing device to perform the image development without being replenished with the toner from the toner replenishing device, the discharge mode, following the non-replenishment mode, for discharging the toner remaining in the developing device and the refill mode, following the discharge mode, for refilling the toner into the developing device by the toner replenishing device.

Thus, if the deterioration of the toner in the developing device is thought to have progressed, for example, due to a long-term use, the controller executes the non-replenishment mode to perform the image development while stopping the toner replenishing operation by the toner replenishing device. Therefore, a charge failure caused by the replenished toner can be pressed.

If the deteriorated toner in the developing device is effectively used up and a toner remaining amount decreases to such an extent as to cause an image defect in the non-replenishment mode, the controller executes the discharge mode to discharge the toner in the developing device as much as possible without performing any image formation.

After the toner is discharged in the discharge mode, the controller executes the refill mode to refill the new toner into the developing device. In this way, the toner in the developing device can be refreshed.

Accordingly, there can be provided an image forming apparatus usable over a long term without replacing the developing device by suppressing occurrences of the fogging and linear nonuniformity of images caused by the toner replenishment.

(2) It is preferable that the toner replenishing device includes a replaceable toner container containing the toner to be replenished into the developing device and a detector for detecting whether or not the toner container is replaced; and that the controller executes a control in the non-replenishment mode after detecting the replacement of the toner container by the detector.

In this case, since the control is executed in the non-replenishment mode after the replacement of the toner container, a toner container replacement timing can be set before a transfer is made to the non-replenishment mode when the toner runs out in the toner container, wherefore the usable life of each toner container can be stabilized.

(3) Preferably, the controller includes a dot counter for counting the dot number of an image to be printed and estimates an amount of the toner used for image development by the developing device based on the dot number at the time of image formation during the execution of the non-replenishment mode upon transferring from the non-replenishment mode to the discharge mode.

The dot number at the time of image formation corresponds to the number of points (dots) of development with the toner upon forming an image. The larger the number of spots (range) to be developed within one image, the larger the dot number. Conversely, the smaller the number of spots (range), the smaller the dot number.

In other words, the consumed amount of the toner in the non-replenishment mode is substantially proportional to the dot number of the image to be printed. Thus, the transfer timing to the discharge mode can be accurately specified if the controller estimates an approach to the limit of continuing the printing in the non-replenishment mode based on the dot number.

(4) The controller preferably causes the toner replenishing device to replenish the toner with the image developing operation by the developing device stopped until a specified reference amount of the toner is replenished into the developing device during the execution of the refill mode.

Since the refill mode is started with the deteriorated toner in the developing device almost discharged, only a very small amount of the toner is replenished at first. If the developing device (developing roller) is driven in this state, a small amount of the toner might possibly come out of the developing device.

Accordingly, the driving of the developing device is stopped until a certain amount of the toner is filled, and the developing device (developing roller) is driven after the reference amount of the toner is filled. Therefore, it can be effectively prevented that the toner comes out during the refilling.

(5) It is preferable that a agitator for causing the toner replenished into the developing device to flow is further provided; and that the controller causes the agitator to flow the toner after the toner is replenished into the developing device by the toner replenishing device during the execution of the refill mode.

The above agitator causes the toner replenished into the developing device to flow, thereby promoting the leveling of the toner. Specifically, the toner aggregated in the developing device is leveled in the longitudinal direction of the developing roller to be evenly dispersed. Therefore, the stabilization of images can be promoted by preventing an unbalanced toner supply amount to the developing roller.

(6) The controller preferably executes the discharge mode by causing the developing device to develop a solid image.

In this case, the toner in the developing device can be quickly discharged.

(7) It is preferable that an image density sensor for detecting the density of the solid image is further provided; and that the controller transfers the mode from the discharge mode to the refill mode if the density of the solid image detected by the image density sensor is lower than a specified density.

Since the toner remaining in the developing device is detected by detecting the density of the solid image in this case, the transfer timing to the refill mode can be accurately specified.

(8) The toner is preferably a one-component developer.

In this case, even in the developing device using the one-component developer, there can be provided an image forming apparatus usable over a long term without replacing the developing device by suppressing occurrences of the fogging and linear nonuniformity of images caused by the toner replenishment.

This application is based on patent application No. 2007-129438 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus, comprising:

a photoconductor to have an electrostatic latent image formed thereon;

a developing device for developing the electrostatic latent image with a toner;

a toner replenishing device for replenishing the toner into the developing device; and a controller for controlling an image developing operation by the developing device and a toner replenishing operation by the toner replenishing device, wherein the controller executes a non-replenishment mode for causing the developing device to perform image development without being replenished with the toner from the toner replenishing device, a discharge mode, following the non-replenishment mode, for discharging the toner remaining in the developing device and a refill mode, following the discharge mode, for refilling the toner into the developing device by the toner replenishing device, and the controller includes a dot counter for counting the dot number of an image to be printed and estimates an amount of the toner used for image development by the developing device based on the dot number at the time of image formation during the execution of the non-replenishment mode upon transferring from the non-replenishment mode to the discharge mode.

2. An image forming apparatus according to claim 1, wherein:

the toner replenishing device includes a replaceable toner container containing the toner to be replenished into the developing device and a detector for detecting whether or not the toner container is replaced; and the controller executes a control in the non-replenishment mode after detecting the replacement of the toner container by the detector.

3. An image forming apparatus according to claim 1, wherein the controller causes the toner replenishing device to replenish the toner in a state where the image developing operation by the developing device is stopped, until a specified reference amount of the toner is replenished into the developing device during the execution of the refill mode.

4. An image forming apparatus according to claim 3, further comprising an agitator for causing the toner replenished into the developing device to flow, wherein the controller causes the agitator to flow the toner after the toner is replenished into the developing device by the toner replenishing device during the execution of the refill mode.

5. An image forming apparatus according to claim 1, wherein the controller executes the discharge mode by causing the developing device to develop a solid image.

6. An image forming apparatus according to claim 5, further comprising an image density sensor for detecting the density of the solid image, wherein the controller transfers the mode from the discharge mode to the refill mode if the density of the solid image detected by the image density sensor is lower than a specified density.

7. An image forming apparatus according to claim 1, wherein the toner is a one-component developer.

* * * * *